US005125178A

United States Patent [19]

Justice

[11] Patent Number: 5,125,178

[45] Date of Patent: Jun. 30, 1992

[54] RIFLE SAFETY LOCK APPARATUS

[76] Inventor: Jerry P. Justice, 2164 Warwick, Houston, Tex. 77093

[21] Appl. No.: 544,686

[22] Filed: Jun. 27, 1990

Related U.S. Application Data

[63] Continuation-in-part of Ser. No. 482,652, Feb. 21, 1990, Pat. No. 4,972,618.

[51] Int. Cl.[5] ..... F41A 17/74

[52] U.S. Cl. ..... 42/70.11

[58] Field of Search ..... 42/70.08, 70.11

[56] References Cited

U.S. PATENT DOCUMENTS

| | | | |
|---|---|---|---|
| 835,349 | 11/1906 | Deming | 42/70.11 |
| 1,227,531 | 5/1917 | Donadio . | |
| 2,945,316 | 7/1960 | Mulno . | |
| 3,462,869 | 8/1969 | Wallace . | |
| 3,553,877 | 1/1971 | Welch et al. | 42/70.11 |
| 3,673,725 | 7/1972 | Cravener | 42/70.11 |
| 3,882,622 | 5/1975 | Perlotto | 42/70.11 |
| 4,972,618 | 11/1990 | Justice, Sr. et al. | 42/70.11 |
| 5,042,185 | 8/1991 | Justice, Sr. | 42/70.11 |

*Primary Examiner*—Charles T. Jordan

*Attorney, Agent, or Firm*—Pravel, Gambrell, Hewitt, Kimball & Krieger

[57] ABSTRACT

A locking mechanism for a lever action or pump action rifle that completely disables the weapon when in the locked position. The mechanism includes a set screw that is inserted in a small hole drilled in the side of the rifle side plate above the trigger. The set screw has attached to it a small button such that when the mechanism is in a locked position, the button located on the screw is extended into a blind hole formed in the hammer, thereby preventing pivotal movement of the hammer, and consequently preventing operation of the trigger and the lever or pump. When the mechanism is in an unlocked position, the rifle functions as originally intended by the manufacturer.

2 Claims, 3 Drawing Sheets

RIFLE SAFETY LOCK APPARATUS

This application is a continuation-in-part of co-pending U.S. patent application Ser. No. 482,652 filed Feb. 21, 1990, now U.S. Pat. No. 4,972,618 for Revolver Safety Lock Apparatus. The named inventor in this application was a co-inventor in the parent application.

BACKGROUND OF THE INVENTION

1. Field of the Invention

The present invention relates generally to safety devices for firearms, and more particularly to a safety locking device for a pump or lever action rifle which may be incorporated into an existing weapon design or, alternatively, may be installed in a premanufactured weapon, wherein the safety locking device includes a mechanism for locking the hammer, thereby locking the trigger and the pump or lever into place and preventing the operation of the rifle.

2. Description of the Prior Art

The desirability of safety mechanisms on firearms has long been recognized and their presence on handguns and rifles, as well as on other types of weapons, is common. Typically, these safety mechanisms are simple toggle devices movable between safe and ready positions. In the safe position, the safety acts either to prevent the trigger from being pulled, prevent the hammer from being cocked, or prevent an already cocked hammer from being moved to strike the firing pin. A second type of safety mechanism commonly used in lever action and pump action rifles involves placing the hammer in a half cocked position midway between the cocked position and the firing position. This type of safety mechanism is generally unsatisfactory because a certain amount of pressure such as if the rifle were accidentally dropped could release the hammer and cause an accidental discharge of the weapon. Furthermore, the rifle is not tamperproof, and an unauthorized user such as a child can easily disengage the safety mechanism.

Many of the known patents for safety mechanisms on firearms have utilized some type of hammer-block or hammer-lock to prevent the firearm from discharging. However, these safety devices do not prevent the unauthorized use of the firearm, but merely act to prevent an accidental discharge of the firearm when the safety is activated. Due to the increasing number of gun-related accidents and deaths occurring nationally, especially those occurring among children, it is desirable that a safety mechanism for a firearm include a locking capability such that the safety mechanism cannot be readily disabled without an external device such as a key. The necessity for safety locking devices for firearms has resulted in legislation in at least one state requiring that firearms be sold with a trigger safety locking device that can be attached to the trigger. This type of trigger safety locking device fits over the trigger in such a way as to prevent access to the trigger of the weapon. However, this device is generally unsatisfactory because it does not render the trigger completely tamperproof and does not prevent an accidental discharge of the weapon. As an example of other safety locking devices, U.S. Pat. No. 2,945,316 discloses a hammer blocking safety for a revolver which is operable by a specially designed key. A spring loaded rod having a hammer block at one end is retained within the revolver handle frame. U.S. Pat. No. 3,462,869 discloses a key operated safety lock device for a revolver wherein a lock cylinder acting as a hammer block is mounted within the frame of the revolver.

Most of the locking devices for firearms mentioned above are relatively expensive in that they generally require major modifications to the firearm. These modifications generally alter the appearance of the firearm to a noticeable degree. It is an object of the present invention to provide a reliable safety lock for a pump action or lever action rifle capable of disabling the weapon when in the locked position. Furthermore, it is desirable for the safety lock to be adaptable to premanufactured firearms without appreciable cost and with minimal modification to the weapon.

U.S. Pat. No. 4,972,618, the parent to this application, discloses an internal locking mechanism for a revolver type firearm. The locking mechanism disclosed therein locks the hammer, trigger and cylinder release for a revolver, thereby rendering the firearm inoperable.

U.S. Pat. No. 5,092,185, a prior continuation in part to the parent application referenced above, discloses an internal locking mechanism for a semi-automatic pistol. The locking mechanism locks the hammer, trigger, and slide into place, thereby rendering the firearm inoperable.

SUMMARY OF THE INVENTION

The present invention is directed to a locking mechanism for a pump or lever action rifle which locks the hammer in the half cocked or "safe" position midway between the firing position and the locked position. As a result, the trigger and the pump or lever are also locked. When the locking apparatus is in a locked position, the rifle is completely inoperable and virtually tamperproof. Furthermore, the installation of the present invention requires minimal modification to a premanufactured weapon and may also be easily incorporated into an existing weapon design.

In the instance of a premanufactured weapon, a small hole is drilled in the side of the receiver of the firearm above the trigger and adjacent to the hammer. The hole is threaded and includes an internal small counterface adapted to receive a locking pin. The locking pin is comprised of a set screw having threads which match those in the side plate hole and a flat cylindrical button attached to the set screw. The locking pin is adapted to fit flush within the counterface when the set screw is fully retracted. The set screw has a selected drive or locking means, e.g., an allen drive, star drive, phillips drive, etc., that is removable from the locking pin. A blind hole is drilled in the hammer coaxial to the hole in the receiver, when the hammer is in the safe or half cocked position, that is adapted to receive the flat cylindrical button when the locking mechanism is engaged.

The normal safety mechanism for the rifle is preferably engaged by first placing the hammer in the half cocked position. The safety locking apparatus according to the present invention is then placed in a locked position by rotating the set screw clockwise utilizing the selected drive means, thereby extending the cylindrical button into the blind hole formed in the hammer. The cylindrical button engages and locks the hammer, preventing rotational movement of the hammer and, consequently, preventing movement of the trigger. Furthermore, as a consequence of the hammer being locked, the pump or lever of a pump action rifle or a lever action rifle, respectively, is rendered inoperable, rendering it impossible for a cartridge from the magazine to be chambered into the weapon. To unlock the weapon, the selected drive means is used to rotate the locking pin set screw counterclockwise to retract the button from the blind hole in the hammer to the counterface formed in the side plate of the receiver.

Therefore, the safety locking apparatus according to the present invention virtually disables the weapon when in the locked position. The weapon remains disabled until the removable drive means is applied to the locking pin to unlock the weapon. When the safety mechanism is in the unlocked position, the weapon functions as originally intended by the manufacturer.

BRIEF DESCRIPTION OF THE DRAWINGS

A better understanding of the invention can be obtained when the following detailed description of the preferred embodiment is considered in conjunction with the following drawings, in which.

DETAILED DESCRIPTION OF THE PREFERRED EMBODIMENT

Figure 1:
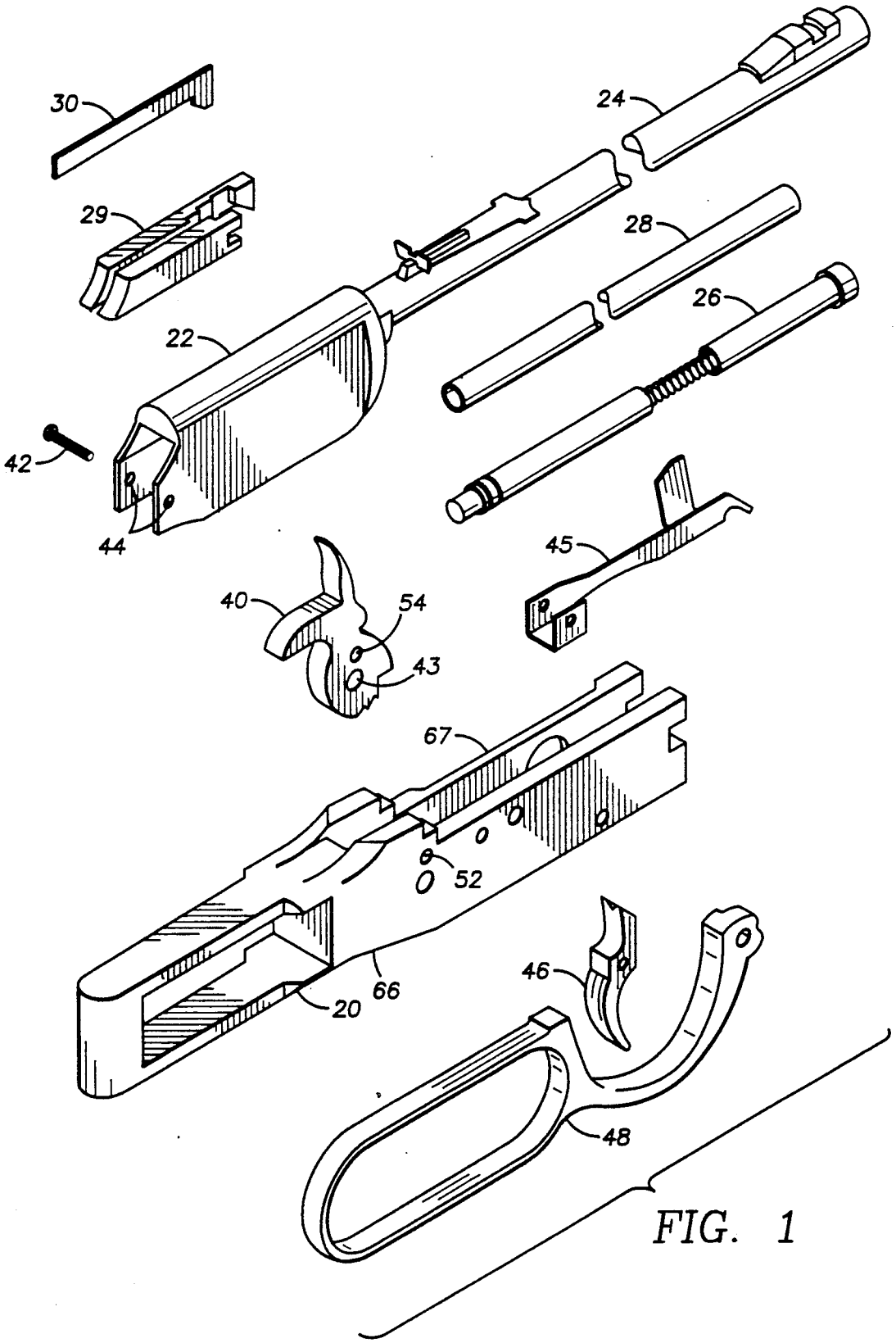
FIG. 1 is an expanded view of a lever action rifle incorporating the present invention.

Referring now to FIG. 1, an exploded view of a lever action rifle R1 is generally shown. In one embodiment of the present invention, the lever action rifle used is a Winchester Model 9422 lever action rifle, but the incorporation of the present invention into other types of rifles, including both lever action rifles and pump action rifles, is also contemplated. Many of the details of a rifle that are not relevant to the present invention have been omitted for the purpose of clarity. The lever action rifle R1 includes a receiver 20 having a right side plate 66 and a left side plate 67. The rifle R1 also includes a barrel frame 22, a barrel 24, a spring loaded rod 26 which fits into a magazine 28, a breech 29, and a firing pin 30. The rifle R1 includes a pivotable cartridge striking hammer 40 rotatable about a pivot pin 42 and having a first cocked and second firing position. The hammer 40 is spring biased within the receiver 20 and the barrel frame 22 toward the barrel 24. The hammer 40 is supported by a hammer support piece 45 which is placed in the receiver 20 and the barrel frame 22. The pivot pin 42 is inserted through the hammer support piece 45, the hammer 40, the receiver 20, and the barrel frame 22. The hammer 40 is thus retained within the rifle R1 and pivots between its first and second position about its pivot point or axis 43. The hammer 40 has a first (cocked) position against the spring bias and away from the barrel 24 preparatory to striking a cartridge (not shown) and a second (firing) position wherein it strikes the firing pin 30 to discharge a cartridge. The hammer 40 moves into its first (cocked) position by action of the breech 29. Movement of the breech 29 away from the barrel 24 rotates the hammer 40 about its axis 43 away from the barrel 24, placing it in its first (cocked) position. The hammer 40 is moved to its second (firing) position by spring bias when activated by a trigger 46, which rotates the hammer 40 about its axis 43 toward the barrel 2 striking the firing pin 30 and discharging a cartridge.

The rifle R1 includes a lever 48 which is manually moved away from the trigger 46 to clear the firing chamber and to move the breech 29 away from the barrel 24, thereby placing the hammer 40 into its first (cocked) position. The lever 48 is then returned to its original position in order to supply cartridges to the rifle firing chamber. The rifle R1 also includes a safety locking mechanism according to the present invention (not shown) which is preferably inserted through a hole 52 formed in the right side plate 66 of the receiver 20. The safety locking mechanism is adapted to mate with a blind hole 54 formed in the hammer 40 when the safety locking mechanism is in the locked position. The lever action rifle R1 also includes a safety feature wherein the hammer 40 may be manually moved to a half cocked position. This involves retracting the hammer 40 from the firing pin 30 midway between the first (cocked) position and the second (firing) position, which thereafter prevents movement of the hammer 40 to its second (firing) position.

Figure 2:
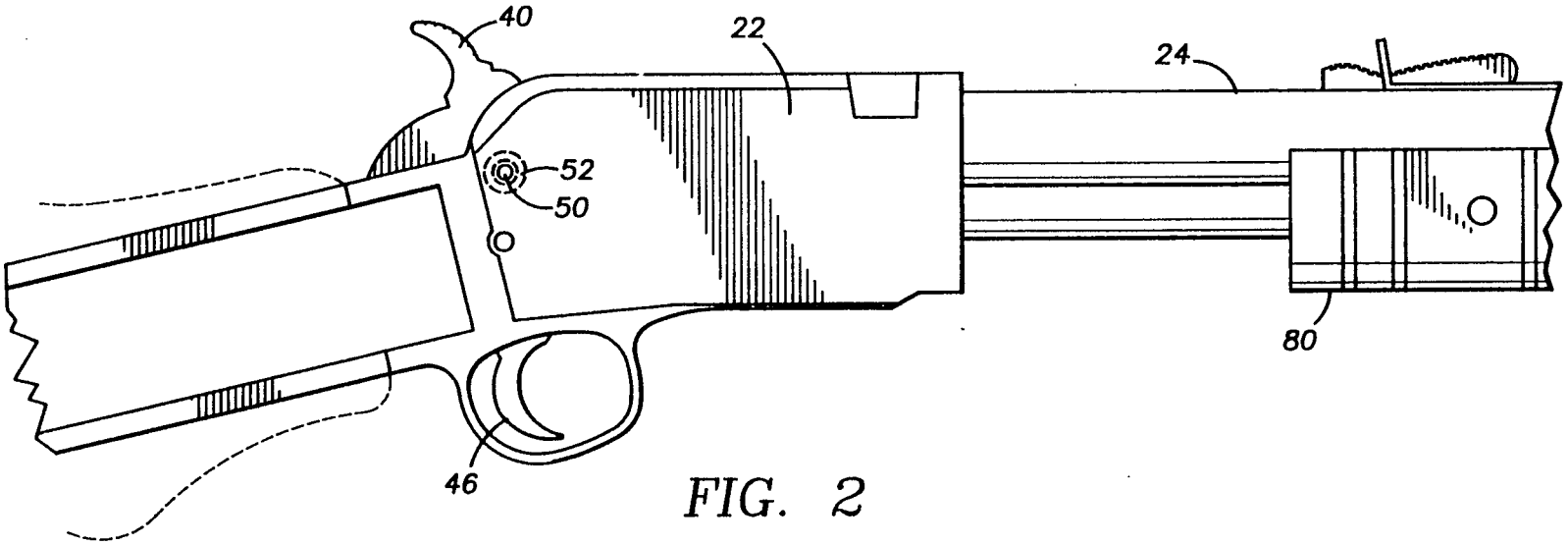
FIG. 2 is a side view of a pump action rifle incorporating the present invention.

Referring now to FIG. 2, a side view of a pump action rifle R2 incorporating the present invention is generally shown. The present invention may be incorporated into either a lever action rifle or a pump action rifle, and the present invention operates irrespective of the type of rifle chosen. The pump action rifle R2 is similar in most respects to the lever action rifle RI discussed above except that the pump action rifle R2 includes a pump 80 located on the barrel 24 of the rifle R2. The pump 80 is moved in a lateral manner toward the trigger 46 to clear the chamber and to move the breech away from the barrel 24, thereby cocking the hammer 40. The pump 80 is then returned to its original position to chamber a cartridge in the chamber. The pump 80 on the pump action rifle R2 performs the same purpose as does the lever 48 on the lever action rifle R1 discussed above. The pump action rifle R2 includes many of the same elements of the lever action rifle R1 discussed above, and similar elements in FIG. 2 are marked identically to those in FIG. 1 for the purpose of clarity. The safety locking device 50 is inserted into a small hole 52 drilled into the right side plate 66 of the receiver 20. The pump action rifle R2 includes a safety feature similar to that discussed above in the lever action rifle R1 in that the hammer 40 may be manually moved to a half cocked position midway between the firing position and the cocked position. For the purpose of the present invention, the only difference between the lever action rifle RI and the pump action rifle R2 is that the lever action rifle R1 utilizes a lever 48 to move the breech 29 and chamber a cartridge into the weapon, whereas the pump action rifle R2 utilizes a pump 80 to perform the same function. In the description that follows, the safety locking mechanism 50 is discussed with reference to both the lever action rifle R1 and the pump action rifle R2 discussed above.

Figure 3:
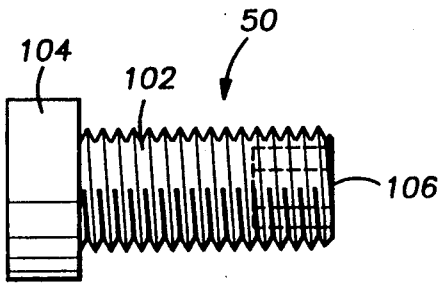
FIG. 3 is a side view of the safety locking apparatus of the present invention.
Figure 4:
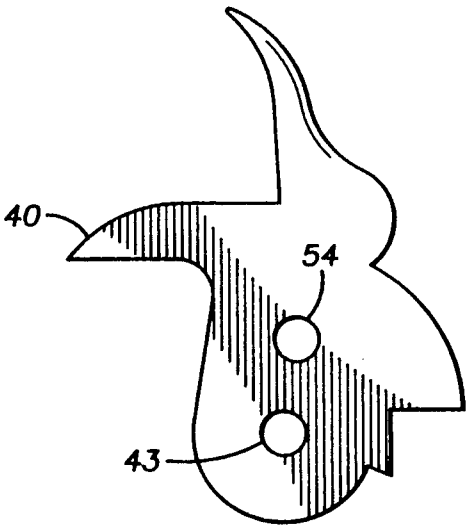
FIG. 4 is a side view of the hammer of the rifles of FIGS. 1 and 2 according to the present invention.

Referring now to FIG. 3, the safety locking mechanism 50 is comprised of a set screw 102 having a thread mating with the thread in the hole 52 (not shown) in the receiver 20 which can be actuated by a selected drive or locking means (not shown) which is adapted to mate with the socket 106 of the screw 102. The drive means may include an allen wrench drive, star drive, phillips drive or other means of rotating the set screw 102. Attached to the end of the screw 102 is a flat cylindrical button 104 which is adapted to mate flush with the blind hole 54 formed in the hammer 40 when activated. The flat cylindrical button 104 is attached to the set screw 102 preferably by a mechanical means such as welding. In an alternative embodiment of the present invention, the set screw 102 and the flat cylindrical button 104 are a unitary piece. Further, while the present embodiment contemplates a cylindrical button 104 co-axial with the set screw 102, it is understood that other locking means which are non-coaxial with screw 102 may be used. Referring now to FIG. 4, a side view of the hammer 40 is generally shown. When the screw is activated, the flat cylindrical button is extended into the blind hole 54 in the hammer, thereby preventing pivotal movement of the hammer 40 about its pivot point or axis 43.

Figure 5:
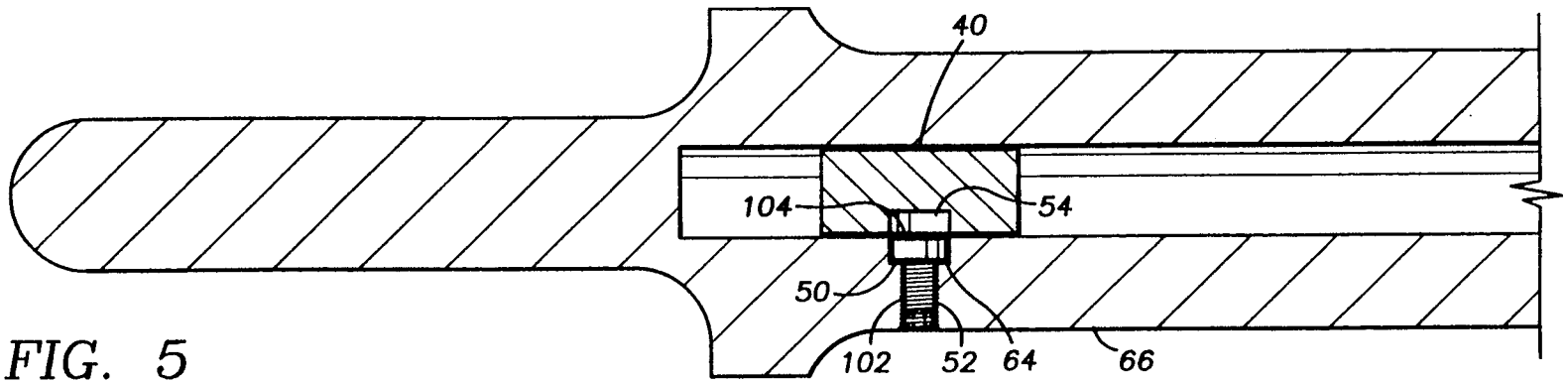
FIG. 5 is a top view of the rifles of FIGS. 1 and 2 showing the safety locking apparatus in its unlocked position according to the present invention.

Referring now to FIG. 5, a cutaway top view of the receiver 20 of a rifle incorporating the present invention, which may be either the lever action rifle R1 or the pump action rifle R2, is shown. The installation of the safety locking apparatus 50 requires some minor modifications to the original parts of a premanufactured weapon. A hole 52 is drilled or tapped into the right side plate 66 of the receiver 20 adjacent to and coaxial with the blind hole 54 machined in the hammer 40 and is also counterbored 64 on the inside face of the side plate 66. In one embodiment of the present invention, the hole 52 is threaded 8-32 and counterbore 64 is at a 0.187" diameter and is 0.06" deep on the inside face of the side plate 66 of the receiver 22. However, the use of other specifications to drill the hole 52 and the counterbore 64 according to the present invention is also contemplated. In addition, the blind hole 54 is drilled in the hammer 40 such that the hole 52 in the side of the receiver 20 is adjacent to and co-axial with the blind hole 54 in the side of the hammer 40 when the hammer 40 is in its safe or half cocked position.

Therefore, if the rifle R1 or R2 includes a safety feature whereby the hammer 40 may be placed in a half cocked position, then preferably the hammer 40 is moved to its half cocked position, which retracts the hammer 40 away from the firing pin 30, before the safety locking apparatus 50 according to the present invention is activated. In this instance, the retraction of the hammer 40 caused by placing the hammer 40 in the half-cocked position is taken into account when determining the predetermined location of the blind hole 54 in the hammer 40, thereby permitting the safety locking mechanism 50 to correctly align with the blind hole 54 when in the locked position. The safety locking apparatus 50 is threaded into the hole 52 in the right side plate 66 of the receiver 20 from the inside face of the right side plate 66 and the rifle RI or R2 is reassembled. The selected drive means (not shown), which is adapted to mate with the socket 106 of the safety locking apparatus 50, is thereafter used to rotate the locking apparatus 50.

Figure 6:
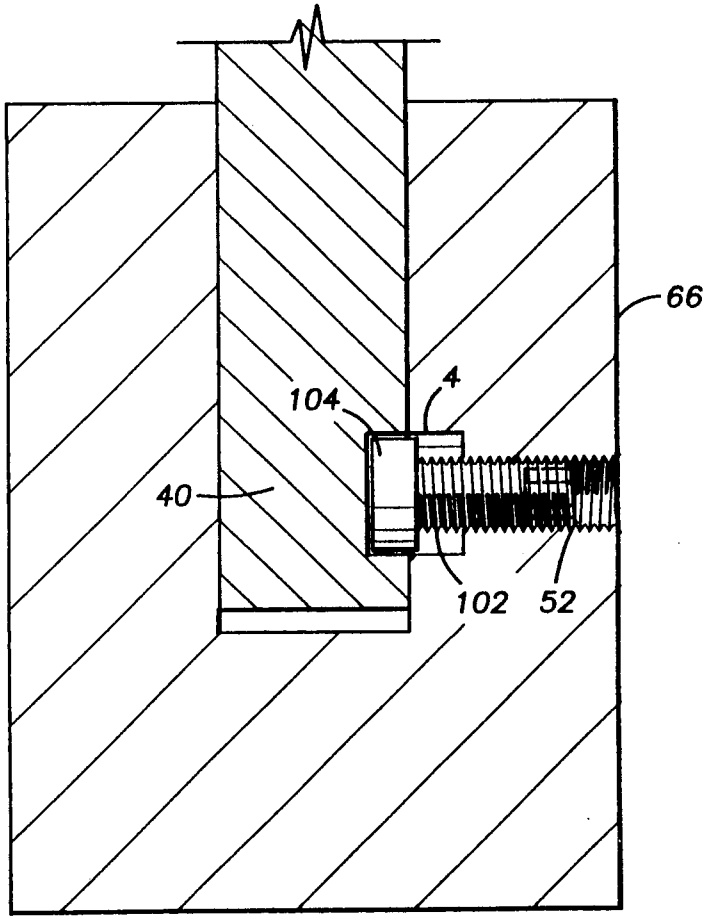
FIG. 6 is a side view of the safety locking apparatus in its locked position according to the present invention.

Referring now to FIG. 6, the hammer 40, which is shown shaded in the diagram for clarity, is shown situated in the receiver 20 of the rifle R1 or R2, and the safety locking apparatus 50 is shown extended into its locked position such that the flat cylindrical button 104 is extended into the blind hole 54 formed in the hammer 40. The blind hole 54 that is formed in the hammer 40 is adapted to mate with the flat cylindrical button 104 when the hammer 40 and the flat cylindrical button 104 are brought into contact. When the safety locking apparatus 50 is installed and is turned clockwise to a "locked" position such that it can no longer be turned by the selected drive means, the flat cylindrical button 104 is extended into the blind hole 54 of the hammer 40 and acts as a hammer lock, thus preventing pivotal movement of the hammer 40 about its axis or pivot point 43 and, consequently, preventing movement of the trigger 40 and the breech 29, thereby preventing operation of the lever 48 or pump 80.

The operation of the safety locking apparatus 50 preferably calls for the hammer 40 to be placed in a half cocked position, aligning the hammer 40 with the blind hole 54 machined in the hammer 40. The safety locking apparatus 50 is then turned clockwise to a "locked" position, which extends the flat button 104 into the blind hole 54 of the hammer 40, thereby preventing further pivotal movement of the hammer 40 about its axis 43. This consequently locks the trigger 46 and prevents movement of the breech 29, thereby preventing operation of the lever 48 or pump 80 of the lever action rifle RI or the pump action rifle R2, respectively. When the safety locking mechanism 100 is turned counterclockwise to an "unlocked" position, the flat button 104 is retracted from the blind hole 54 inside the hammer 40 to the counterface 64 formed in the inside face of the side plate 66, and the rifle R1 or R2 functions as originally intended by the manufacturer. Thus, the present invention virtually disables the weapon when in the locked position. The selected drive means is required to move the safety locking apparatus between the "locked" and "unlocked" positions, thereby rendering the weapon virtually childproof in the "locked" position. Furthermore, the addition of the present invention to a premanufactured weapon requires minimal modification to the weapon.

The foregoing disclosure and description of the invention are illustrative and explanatory, and various changes in the size, shape and materials as well as in the details of the illustrated construction may be made without departing from the spirit of the invention, all such changes being contemplated to fall within the scope of the claims.

I claim:

1. For use in a rifle, the rifle having a hammer, a trigger, a charging mechanism and receiver, the charging mechanism having a first closed position and a second charging position, the hammer having a first cocked position and a second firing position, the hammer being biased toward the second firing position, the hammer being placed in its first cocked position by moving the charging mechanism to its second charging position, the trigger having a first cocked position and a second firing position, the hammer being released to move to its second firing position by moving the trigger to its second firing position, a safety locking apparatus for locking the hammer, trigger and charging mechanism of the rifle, the apparatus comprising:

a selectable means for locking the hammer, trigger and the charging mechanism in its closed position, said locking means being carried by the receiver, the receiver having a means for carrying and retaining a pin within the receiver, the hammer having a blind hole for receiving said pin when the hammer is in its second position, said locking means having a first position in which said pin engages the hammer when the hammer is in its second firing position, preventing rotational movement of the hammer, thereby preventing movement of the hammer, trigger and charging mechanism, said locking means further having a second position in which said pin is disengaged from the hammer, permitting movement of the hammer, trigger and charging mechanism; and means for engaging said locking means and placing said locking means in either its first or second position.

2. For use in a rifle, the rifle having a hammer, a trigger, a charging mechanism and a receiver, the charging mechanism having a first closed position and a second charging position, the hammer having a first cocked position, a second firing position and a third safe position intermediate between said first and second positions, the hammer being biased toward the second firing position, the hammer being placed in its first cocked position by moving the charging mechanism to its second charging position, the trigger having a first cocked position and a second firing position, the hammer being released to move to its second firing position by moving the trigger to its second firing position, a safety locking apparatus for locking the hammer, trigger and charging mechanism of the rifle, the apparatus comprising:

a selectable means for locking the hammer, trigger and the charging mechanism in a closed position, said locking means being carried by the receiver, the receiver having a means for carrying and retaining a pin within the receiver, the hammer having a blind hole for receiving said pin when the hammer is in its third safe position, said locking means having a first position in which said pin engages the hammer when the hammer is in its third safe position, preventing rotational movement of the hammer, thereby preventing movement of hammer, trigger and charging mechanism, said locking means further having a second position in which said pin is disengaged from the hammer, permitting movement of the hammer, trigger and charging mechanism; and means for engaging said locking means and placing said locking means in either its first or second position.

* * * * *